US008146940B2

(12) United States Patent
Hahnenberger

(10) Patent No.: US 8,146,940 B2
(45) Date of Patent: Apr. 3, 2012

(54) ADJUSTABLE STIFFNESS STRAP

(75) Inventor: Treu Hahnenberger, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 373 days.

(21) Appl. No.: 12/326,814

(22) Filed: Dec. 2, 2008

(65) Prior Publication Data

US 2009/0146396 A1 Jun. 11, 2009

Related U.S. Application Data

(60) Provisional application No. 61/012,011, filed on Dec. 6, 2007.

(51) Int. Cl.
*A63C 9/00* (2006.01)

(52) U.S. Cl. ..... 280/617; 280/14.21; 280/14.22

(58) Field of Classification Search ..... 280/14.21, 280/14.22, 623, 619, 618, 633, 624, 11.36, 280/32.5; 16/114.1, 430, 902
See application file for complete search history.

(56) References Cited

U.S. PATENT DOCUMENTS

| | | | | | |
|---|---|---|---|---|---|
| RE24,067 | E | * | 10/1955 | Drogin | 16/114.1 |
| 3,115,227 | A | * | 12/1963 | Shanok et al. | 16/114.1 |
| 6,056,300 | A | | 5/2000 | Carpenter | |
| 6,076,848 | A | | 6/2000 | Rigal | |
| 6,206,403 | B1 | * | 3/2001 | Black et al. | 280/618 |
| 6,250,651 | B1 | * | 6/2001 | Reuss et al. | 280/14.21 |
| 6,283,482 | B1 | | 9/2001 | Coulter | |
| 6,394,484 | B1 | * | 5/2002 | Maravetz et al. | 280/624 |
| 6,520,511 | B2 | * | 2/2003 | Gonthier | 280/11.36 |
| 6,554,297 | B2 | * | 4/2003 | Phillips et al. | 280/14.22 |
| 6,631,919 | B1 | * | 10/2003 | West et al. | 280/633 |
| 6,679,515 | B2 | | 1/2004 | Carrasca | |
| 6,679,516 | B2 | * | 1/2004 | Andrevon | 280/623 |
| 6,938,904 | B2 | * | 9/2005 | Dalgaard | 280/14.21 |
| 7,237,794 | B2 | * | 7/2007 | Elkington et al. | 280/619 |
| 7,306,241 | B2 | | 12/2007 | Cunningham | |
| 2004/0216319 | A1 | * | 11/2004 | Muchnik | 33/666 |
| 2007/0096411 | A1 | * | 5/2007 | Rempe et al. | 280/32.5 |
| 2007/0102900 | A1 | * | 5/2007 | Cunningham et al. | 280/619 |

* cited by examiner

*Primary Examiner* — Hau Phan

(74) *Attorney, Agent, or Firm* — Christensen O'Connor Johnson Kindness PLLC

(57) ABSTRACT

The invention relates to an ankle strap assembly for a snowboard binding. The strap assembly includes a middle strap portion having a stiffening panel with a longitudinal slot defining upper and lower rails, and at least one stiffening member that engages the upper and lower rails. The invention also relates to a method for adjusting the stiffness of a strap assembly for a snowboard binding.

18 Claims, 7 Drawing Sheets

ADJUSTABLE STIFFNESS STRAP

CROSS-REFERENCE TO RELATED APPLICATION

This application claims the benefit of U.S. Provisional Application No. 61/012,011, filed Dec. 6, 2007, the entire disclosure of which is incorporated herein by reference in its entirety.

BACKGROUND

Most binding systems for attaching a rider to a snowboard or other gliding board apparatus rely on one or more straps to hold the rider's boot securely in the binding system. For example, a typical strap-type binding includes a toe strap that extends over the toe of the rider's boot, and an instep or ankle strap that generally extends over the instep and/or ankle portion of the boot.

In a common exemplary snowboard binding the ankle strap is pivotably attached on one side of the binding with a relatively narrow mounting strap that extends upwardly at an angle from binding structure. The mounting strap engages one side of a middle strap portion. The middle strap portion may be contoured and padded, and overlies the boot. The middle strap portion may include a buckle, such as a ratchet-type buckle, that adjustably engages an attachment strap pivotably mounted to the binding, generally opposite the mounting strap. Typically, the attachment strap is a so-called ladder strap having a number of transverse teeth or ridges that are adapted to engage the buckle.

The ankle strap holds the rider's boot securely in the binding structure. Of course, in snowboarding and other gliding board sports the rider's control over the snowboard is generally affected through the rider's connection to the snowboard through the boots and bindings.

Snowboarding is a vigorous and energetic sport, and it will be appreciated that a rider will exert very significant forces to the snowboard through the boots and bindings, repeatedly and over a significant period of time. It is therefore critical that the interface between the rider and the board, and in particular the interface between the rider's boots and the snowboard, be secure and comfortable, as well as facilitating the rider's efforts to control the snowboard, perform tricks and the like.

The ankle strap is an important part of the interface between the rider and the snowboard or other gliding board. Improvements in ankle straps are therefore clearly important to gliding board sports.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, the invention relates to a strap assembly including:

(a) a middle strap portion having a stiffening panel with a longitudinal slot defining upper and lower rails; and (b) at least one stiffening member that engages the upper and lower rails.

In one embodiment, the middle strap portion includes a rear panel defining a longitudinal slot that provides access to the at least one stiffening member.

In one embodiment, the at least one stiffening member includes a center body portion, and oppositely disposed end portions, wherein the end portions have a relatively rigid plastic defining a channel that lockingly and engages one of the upper and lower rails.

In one embodiment, the body portion of the stiffening member comprises a plastic different from the rigid plastic comprising the end portions.

In one embodiment, the body portion of the stiffening member is contoured to define arcuate recesses.

In one embodiment, the rear panel is a polymeric foam. In one embodiment, the polymeric foam rear panel is a co-molded panel formed from at least two polymeric foams.

In one embodiment, the rails include a plurality of slits, and the at least one stiffening member comprises an engagement nib that is sized and positioned to selectively engage the plurality of slits.

In one embodiment, the strap is an ankle strap for a snowboard binding.

In one embodiment, the strap assembly includes a mounting strap adjustably attachable on one side of the middle strap portion, and a buckle fixed to an opposite side of the middle strap portion, wherein the buckle is adapted to engage an attachment strap. In one embodiment, the mounting strap is a slotted-ladder type strap.

In one aspect, the invention relates to a strap assembly including a stiffening panel having a longitudinal slot, and an adjustable means engaging the longitudinal slot, wherein the adjustable means is adapted to change the stiffness of the stiffening panel.

In one embodiment, the longitudinal slot defines upper and lower rails, and the adjustable means is a stiffening member that engages the upper and lower rails.

In one aspect, the invention relates to a method for adjusting the stiffness of a strap assembly for a snowboard binding. The method includes:

(a) providing a middle strap portion of a strap assembly, wherein the middle strap portion has a stiffening panel with a longitudinal slot defining upper and lower rails;

(b) providing at least one stiffening member that engages the upper and lower rails; and (c) changing the position of the at least one stiffening member along the upper and lower rails to adjust the effective stiffness of the strap assembly.

In one embodiment, the at least one stiffening member is removably engaged with the upper and lower rails.

In one embodiment, the at least one stiffening member is adapted to resist deflection of the stiffening panel.

In one embodiment of the method, providing at least two stiffening members increases the stiffness of the strap assembly. In one embodiment of the method, removing the at least one stiffening member decreases the stiffness of the strap assembly.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A particular exemplary embodiment of an ankle strap assembly according to the present invention is described herein with reference to the figures, wherein like numbers indicate like parts. The present invention provides many advantages and functionality. For example, the disclosed strap assembly and method may be used to increase the stiffness of an ankle strap of a snowboard binding, thereby enabling the user to apply greater force to the snowboard through dorsiflexion. Likewise, the disclosed strap assembly and method may be used to decrease the stiffness of an ankle strap of a snowboard binding.

Figure 1:
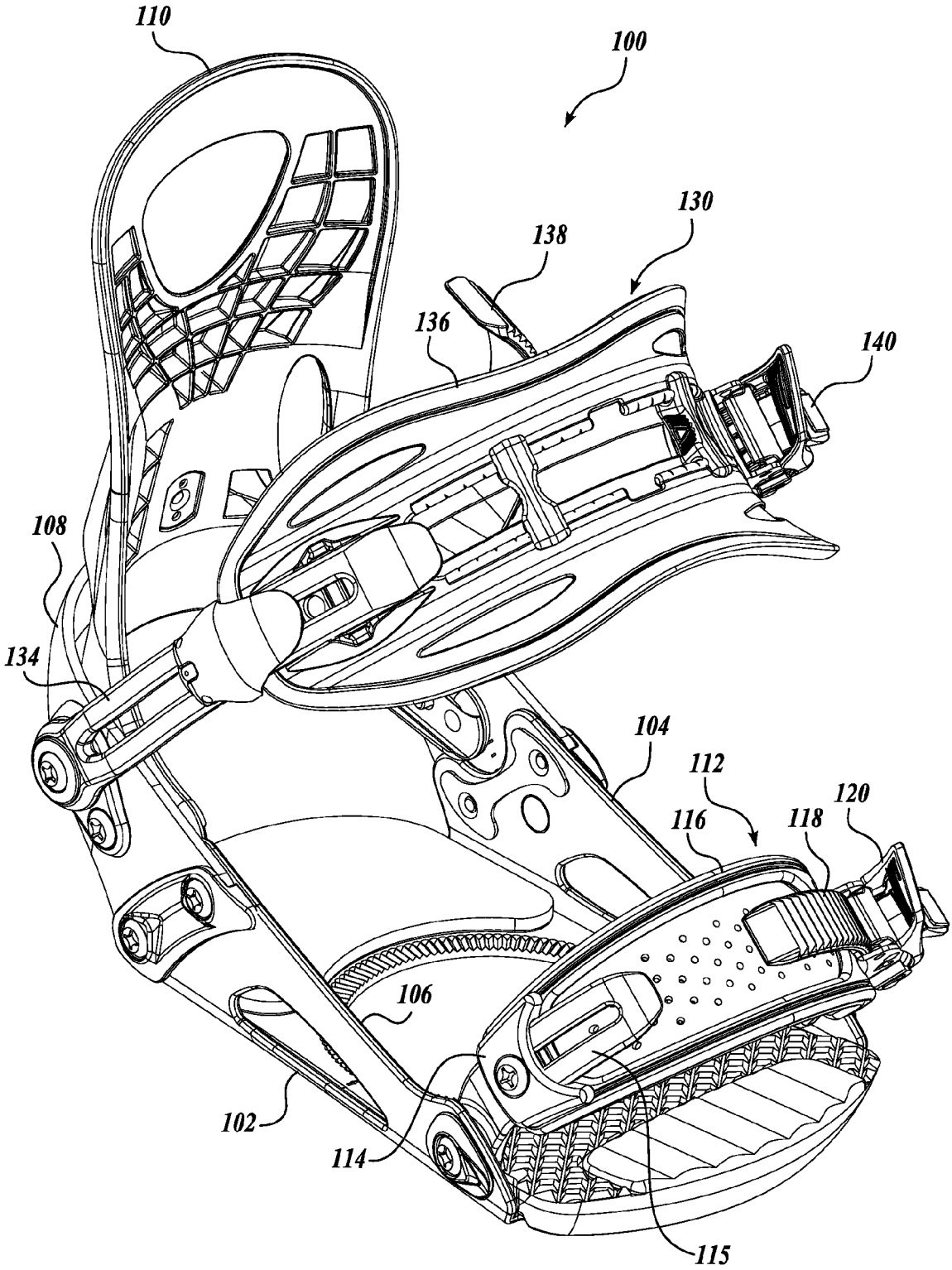
FIG. 1 shows a perspective view of a snowboard binding having an adjustable stiffness ankle strap assembly in accordance with the present invention, wherein the front panel of the ankle strap middle portion is removed to expose the interior of the strap.

For illustrative purposes, a strap in accordance with the present invention will be described with reference to a snowboard binding. However, it is contemplated that the teachings of the present invention will have applications in other devices wherein it is desirable to have a variable stiffness strap assembly. FIG. 1 shows a perspective view of a high-back snowboard binding 100 with a variable stiffness ankle strap assembly 130 in accordance with the present invention, wherein a front panel or covering of the strap assembly is removed to expose the interior structure. The snowboard binding 100 includes a base plate 102 that is adapted to be adjustably mounted to a snowboard, and including oppositely-disposed lateral and medial side walls 104, 106. A generally U-shaped heel loop 108 interconnects the side walls 104, 106 and is positioned to extend behind the boot (not shown) of the rider. The base plate 102, side walls 104, 106 and heel loop 108 may be formed as an integral unit, or assembled in conventional manner. A pivotable high back 110 extends upwardly, to support the back of the rider's leg.

An adjustable toe strap assembly 112 extends between the front portions of the lateral and medial side walls 104, 106. The toe strap assembly 112 includes a mounting strap 115 pivotably mounted to the medial side wall 106, a larger middle strap portion 116 adjustably attached to the mounting strap 115 with a buckle 114, and an attachment strap 118, such as a ladder strap, pivotably attached to the lateral side wall 104. The attachment strap 118 releasably engages a buckle 120 on the middle strap portion 116.

An adjustable stiffness ankle strap assembly 130 is pivotably attached to the base plate 102, and similarly comprises a mounting strap 134 pivotably attached to one side of the base plate 102 (e.g., through the heel loop 108 or to medial side wall 106), and a wider middle strap portion 136 attached to the mounting strap 134. An attachment strap 138 is attached opposite the mounting strap 134 and adapted to adjustably engage a buckle 140, such as a ratchet-type buckle, attached to the middle strap portion 136.

Figure 2:
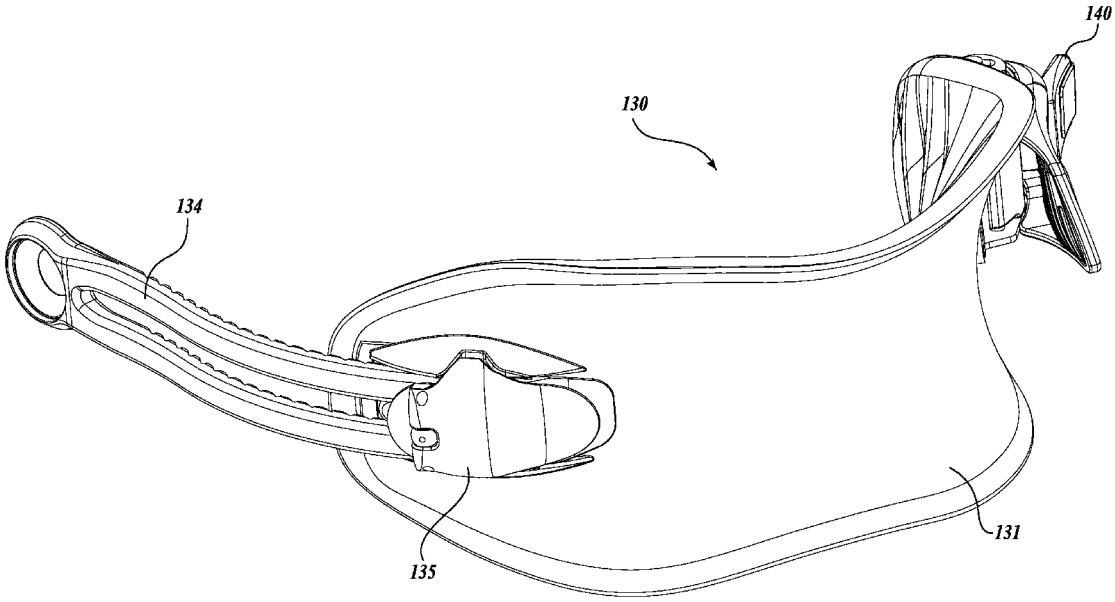
FIG. 2 shows a left-front perspective view of the ankle strap assembly shown in FIG. 1, in isolation.

FIG. 2 shows a left-front perspective view of the ankle strap assembly 130 with the front panel cover 131 of the middle strap portion 136 shown, such that the internal structure of the middle strap portion 136 is not visible. In this particular embodiment, the mounting strap 134 is a slotted ladder-type strap that is adjustably connected to the middle strap portion 136 with buckle 135, such that the lateral position of the middle strap portion 136 can be selectively adjusted.

Figure 3:
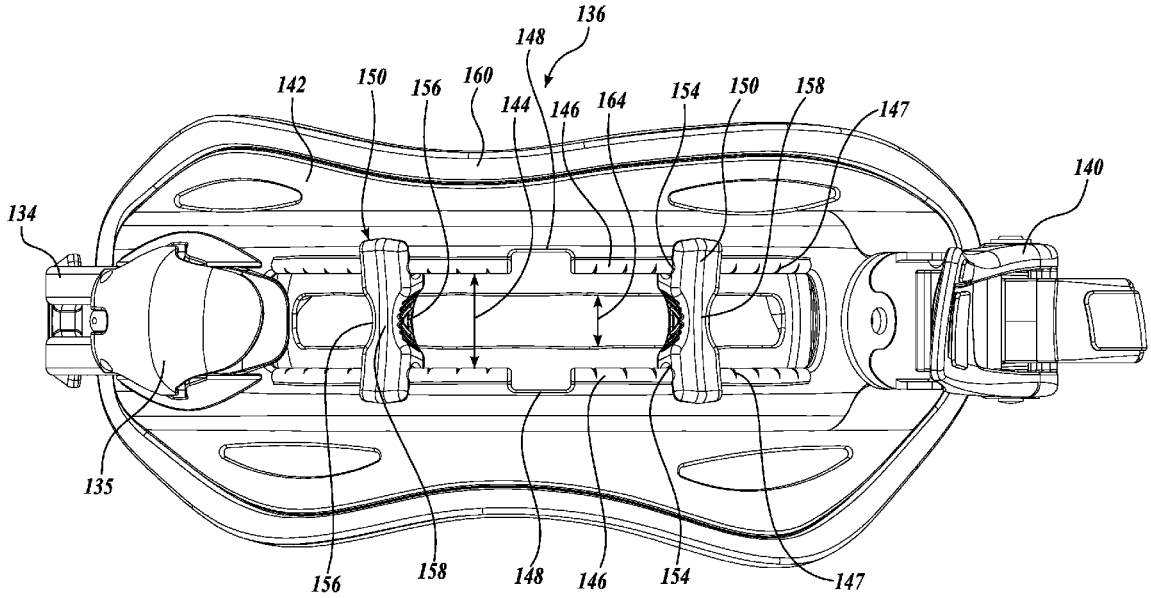
FIG. 3 shows a front view of the ankle strap assembly shown in FIG. 1, with the front panel of the strap middle portion removed to expose the internal structure.

FIG. 3 shows a front view of the ankle strap assembly 130, again with the front panel 131 removed to expose the internal structure of the middle strap portion 136, which will now be described in more detail. The middle strap portion 136 includes a semi-rigid stiffening panel 142 that may be formed, for example, from a polymeric material. The stiffening panel 142 provides additional stiffness to the middle strap portion 136, and is generally contoured to approximately conform to the portion of user's boot that the middle strap portion 136 will overlie. In particular, the stiffening panel 142 provides a degree of stiffness or resistance to bending generally about the long axis of the stiffening panel 142. For example, the stiffening panel 142 tends to resist dorsiflexion, or forward flexure, at the ankle.

It will be appreciated by persons of skill in the art that the stiffness of the middle strap portion will impact the user's "feel" and control of the snowboard, wherein a relatively stiff middle strap portion 136 will enable the user to apply greater force to the snowboard through dorsiflexion and will produce a greater force response to the user when the snowboard rotates about its long axis.

The stiffening panel 142 includes a longitudinal slot 144 that extends through a mid-portion of the stiffening panel 142. The upper and lower edges of the slot 144 are thicker to define oppositely disposed rails 146, which may conveniently be substantially cylindrical. One or more stiffening members 150 (two shown in FIG. 3) slidably engage the rails 146, such that the sliders 150 may be moved inwardly or outwardly from the centerline of the stiffening panel 142. The rails 146 may optionally include spaced-apart locking members such as transverse recesses or slits 147 (shown in FIG. 6). Although slidable stiffening members are disclosed, it will be apparent to persons of skill in the art that alternative stiffening members may be provided that are not slidable, for example being positionable at particular locations.

Figure 7A:
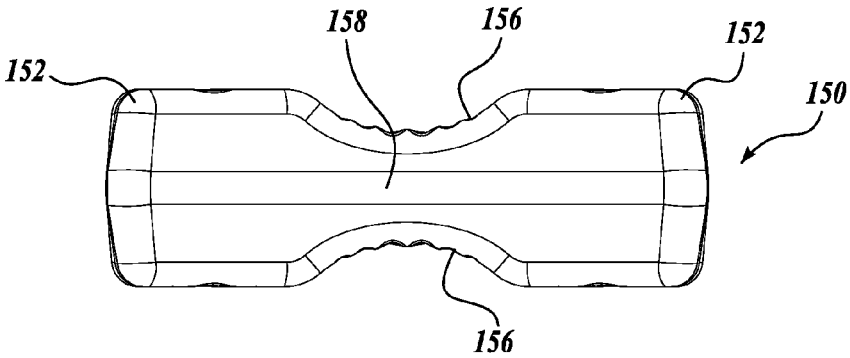
FIGS. 7A-7D shows front, top, end and perspective views of one stiffening member for the ankle strap assembly shown in FIG. 1.
Figure 7B:
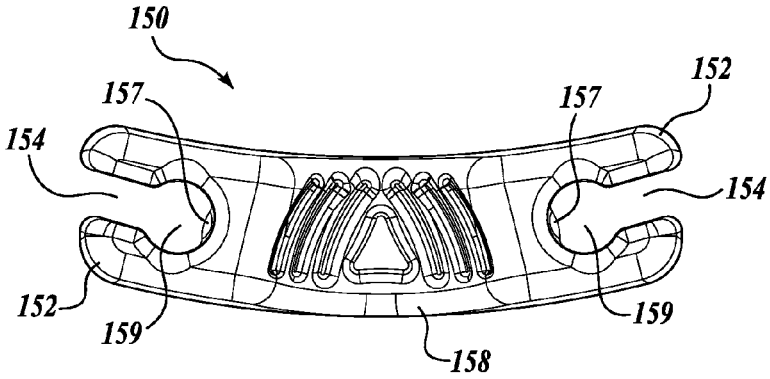
Figure 7C:
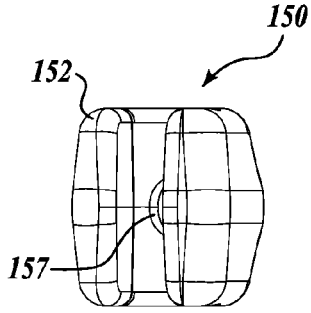
Figure 7D:
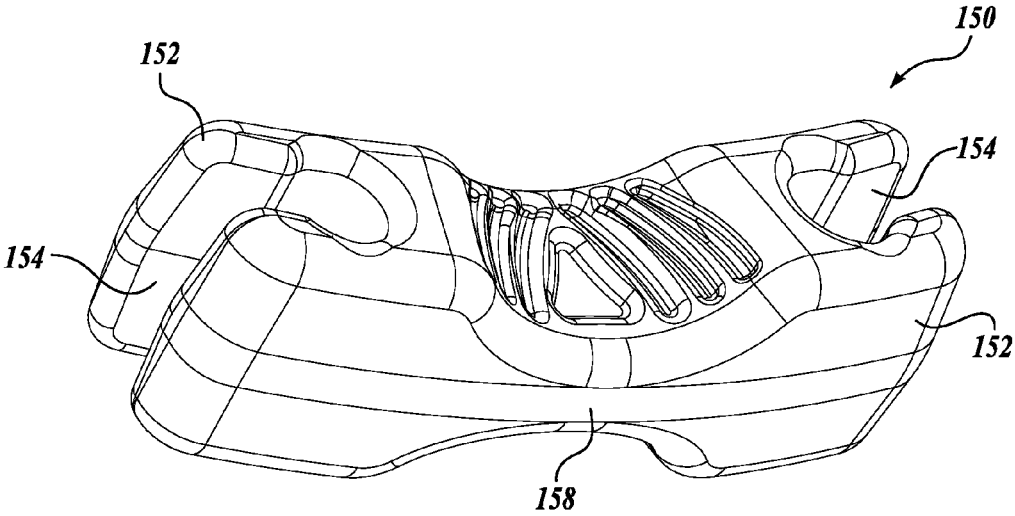

Detail views of the current stiffening member 150 are shown in FIGS. 7A-7D, wherein FIG. 7A is a front view of the stiffening member 150, FIG. 7B is a top view of the stiffening member 150, FIG. 7C is an end or left side view of the stiffening member 150, and FIG. 7D is a perspective view. The stiffening member 150 in this embodiment is a relatively rigid member having opposite ends 152 that each define a channel 154. The channels 154 are sized and shaped to slidably engage the rails 146 defined on the stiffening panel 142, and the stiffening member 150 is sized such that the oppositely disposed channels 154 can engage the oppositely disposed rails 146. In this embodiment, the channels 154 include a larger, cylindrically portion or recess 159 that is sized to engage the rail 146 on the stiffening panel 142. An optional engagement nib 157 may be provided in the recess 159, that is sized and shaped to engage the slits 147, providing a tactile response when the stiffening member 150 is moved along the rails 146. The stiffening member 150 body section 158 is preferably contoured with arcuate recesses 156 on either side to facilitate moving the stiffening member 150 along the rails. As shown in the FIGURES, the recesses 156 may be knurled.

Referring again to FIG. 3, the upper and lower rails 146 are interrupted at an intermediate location (e.g., approximately in the center of the stiffening panel 142) with oppositely disposed cutouts 148. Each stiffening member 150 can be readily installed on, and removed from, the stiffening panel 142, for example by positioning the stiffening member 150 at the cutouts 148, and either moving it transversely to engage the rails 146, or removing the stiffening member 150 from the panel 142.

The rear panel 160 of the middle strap portion 136 can also be seen in FIG. 3, and includes a longitudinal slot 164 that is approximately aligned with the longitudinal slot 144 on the stiffening panel 142. As can be seen most clearly in FIG. 4, which shows a rear perspective view of the ankle strap assembly 130, the slot 164 in the rear panel 160 provides rear access to the stiffening members 150, whereby the user can move the stiffening members 150 along the rails 146, or install or remove stiffening members 150. It will now be appreciated that the longitudinal slot 164 on the rear panel 160 of the middle strap portion 136 provides many advantages. For example, the interior of the middle strap portion 136 is substantially protected from the incursion of foreign matter during use, because the longitudinal slot 164 is closed by the user's boot during use. Additionally, the front panel of the middle strap portion 136 can be designed without having to accommodate a slot or other access to the stiffening members 150, for example to provide a more aesthetically pleasing design.

Figure 4:
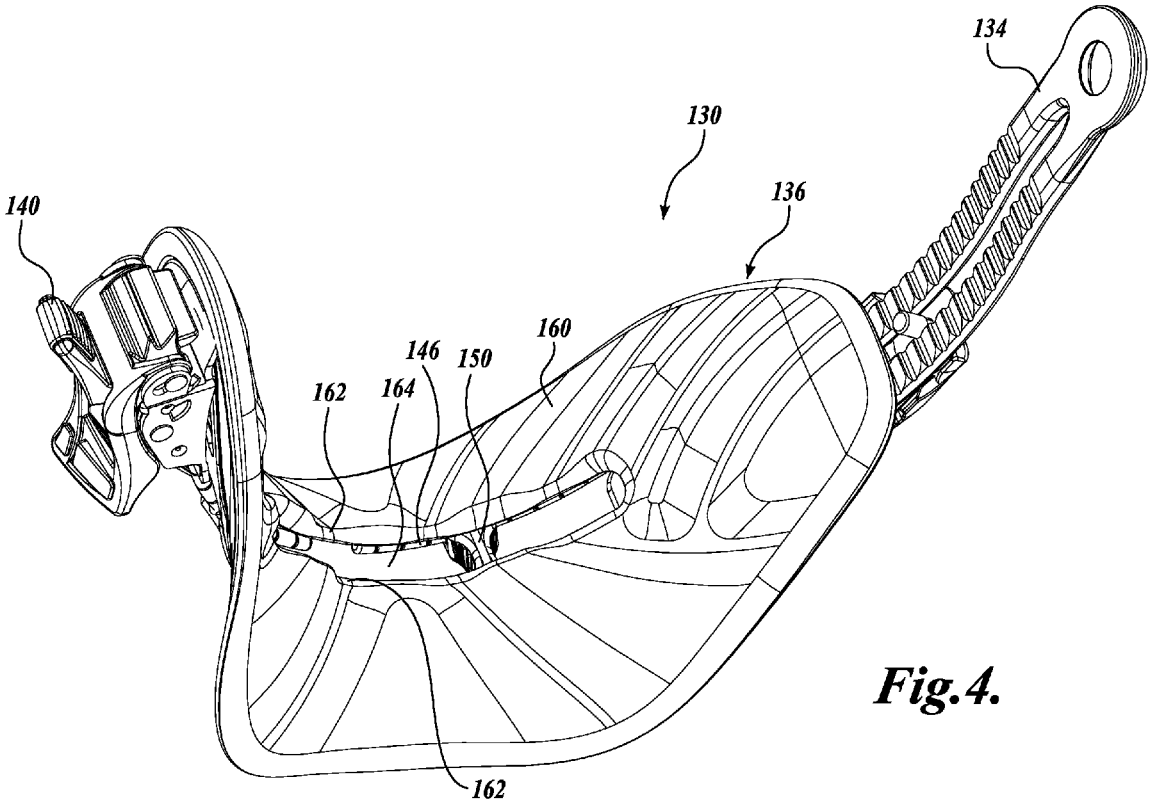
FIG. 4 shows is a rear perspective view of the ankle strap assembly shown in FIG. 1.

Referring still to FIG. 4, the rear panel 160 preferably comprises a conformable, compressible panel having some thickness. For example, in one embodiment the rear panel includes a co-molded EVA and neoprene panel. The rear panel 160 may comprise one or more additional layers, for example a protective and/or ornamental outer layer may also be provided. Preferably, the edge portions 162 defining the longitudinal slot 164 are contoured or curved outwardly, providing some spacing between the panel edges 162 and the stiffening panel 142 when the rear panel 160 is not externally constrained (i.e., is not held against the boot by the straps 134, 138). This spacing facilitates sliding the stiffening members 150 along the rails 146. During use, the flexible rear panel 160 may compress against the stiffening members 150, holding them in a desired position.

In this embodiment, a stiffening member 150 is installed by orienting the stiffening member 150 to generally align across the slot 164, inserting the stiffening member 150 through the slot 164, rotating the stiffening member 150 approximately ninety degrees and positioning it to align with the cutouts 148, and moving the stiffening member 150 such that the channels 154 engage the rails 146.

Figure 5:
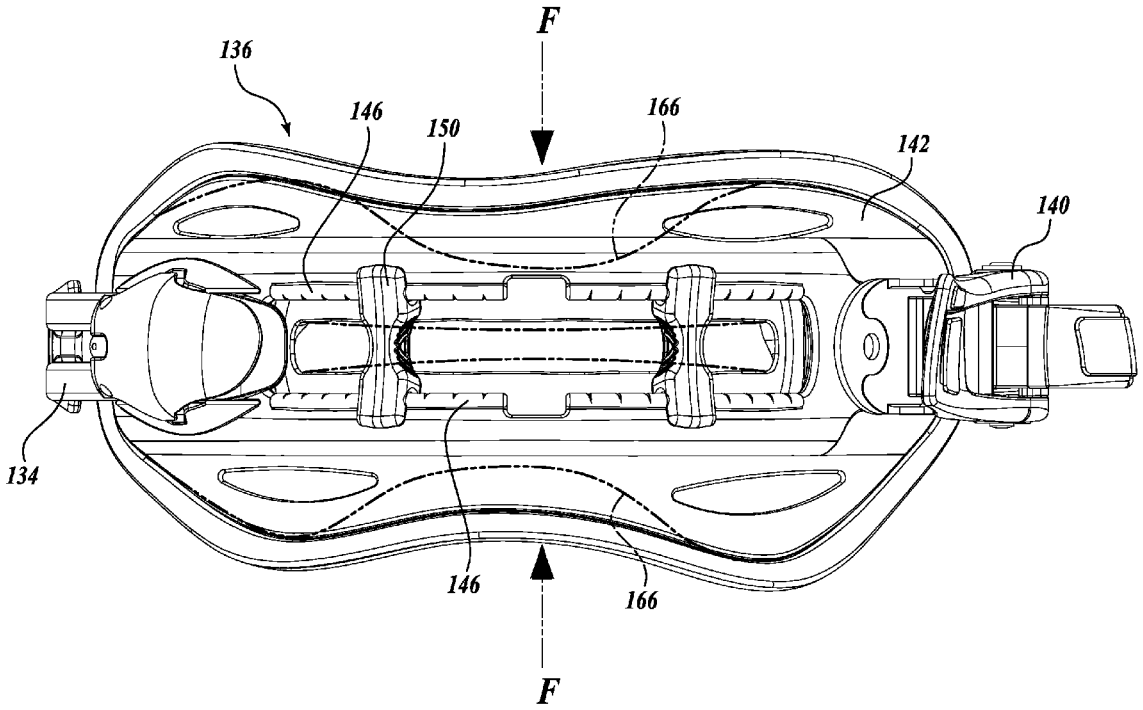
FIG. 5 shows a front view of the ankle strap assembly shown in FIG. 1, with a flexed outline in phantom.

FIG. 5 is similar to FIG. 3, and shows diagrammatical forces F that might be applied to the middle strap portion 136 during use, e.g. from dorsiflexion of the ankle. The dashed lines 166 indicate potential flexure of the edges of the stiffening panel 142 when such forces are applied. It will now be appreciated that the stiffening members 150, which are relatively rigid, will tend to resist deflection of the stiffening panel 142, and therefore tend to reduce the flexibility of the middle strap portion 136 about the long axis. Changing the position of the stiffening members 150 along the rails 146 will change the effective stiffness of the stiffening panel 142, and adding or removing stiffening members 150 will change the effective stiffness of the stiffening panel 142. Therefore, a rider can set the position of the stiffening members 150 (by accessing the stiffening members through the slot 164 in the rear panel 160) to adjust the stiffness of the ankle strap assembly 130.

Figure 6:
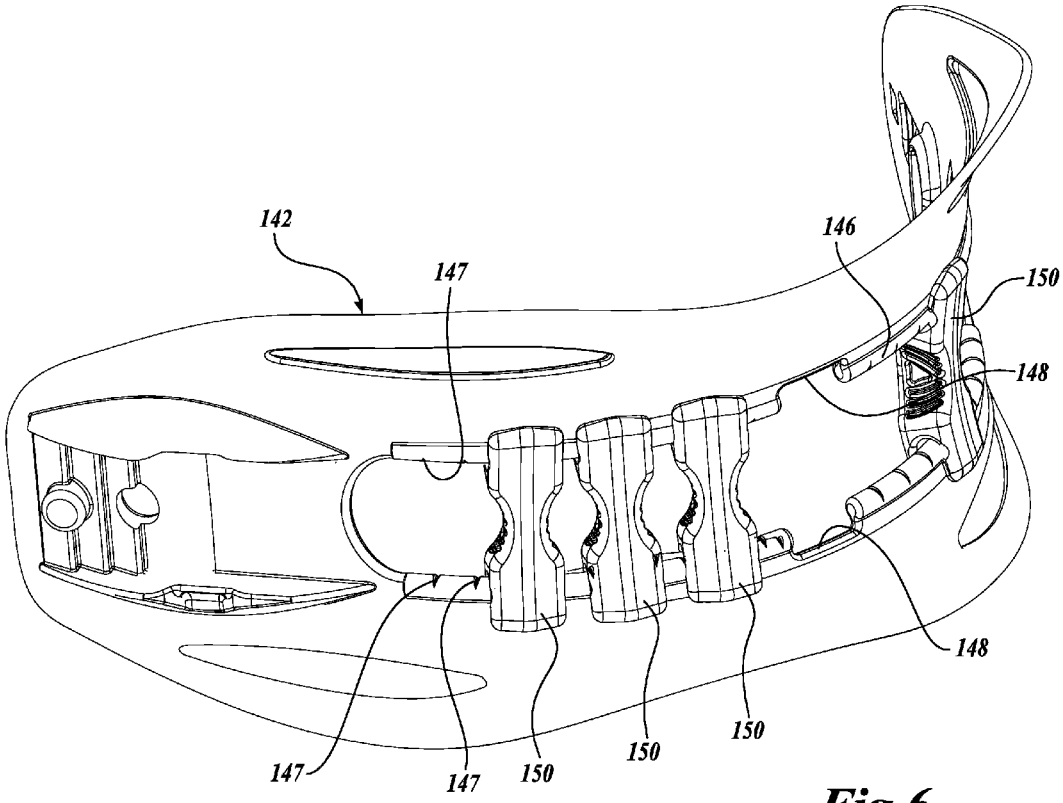
FIG. 6 shows a left front view of the stiffening panel of the middle portion of the ankle strap assembly shown in FIG. 1, with an exemplary alternate positioning of the stiffening members.

FIG. 6 shows a stiffening panel 142 and stiffening members 150 in isolation, with four stiffening members 150 disposed on the rails 146, including three stiffening members 150 on one side. This shows one possible configuration, wherein the rider can adjust the stiffness profile of the strap assembly 130. The rider can selectively adjust the stiffness distribution to vary along the length of the ankle strap assembly 130 by adding additional stiffening members 150, and by judicious placement of the stiffening members 150. For example, it may be advantageous to the rider to adjust the strap assembly 130 such that it is stiffer to dorsiflexion on the medial side, than on the lateral side. The present assembly permits great flexibility in adjusting the strap stiffness by changing the position and/or number of stiffening members 150.

It is contemplated that the stiffening members 150 may also be configured to have different properties along their length, for example to achieve desired stiffness characteristics. In one embodiment, the stiffening members 150 are formed in a co-molding or co-forming process using a more rigid plastic for the ends 152 of the stiffening members 150, such that the channels 154 will not flex significantly (to more securely engage the rails 146), and a more flexible plastic for the body portion 158, for example to provide shock absorption characteristics.

In one embodiment, a strap is provided with a plurality of different stiffening members 150 that have different stiffness characteristics. For example, the one set of stiffening members may be formed from a less flexible material than another set, and/or with a different geometry to achieve different flexing characteristics. This allows a user to more options in adjusting the stiffness properties of the strap, by selecting among a set of stiffening members.

Although the currently preferred strap assembly utilizes stiffening members 150 slidably disposed on rails 146 formed on the stiffening panel 142, other mechanisms may be similarly used, and are specifically contemplated. For example, it will be readily apparent that a rotatable cam-like member may alternatively be disposed between the rails 146, wherein the rotational position of the member adjusts the amount of flexure possible between the rails 146. In such an alternative embodiment, the stiffness of the strap assembly could be adjusted by rotating a dial disposed on the front of the middle strap portion. Such a rotatable member may, or may not, be also movable laterally to adjust the position of the rotatable member within the slot 144.

Although the strap assembly shown in the FIGURES is intended for use with a snowboard binding, the present invention is clearly amenable to use in other applications.

While illustrative embodiments have been illustrated and described, it will be appreciated that various changes can be made therein without departing from the spirit and scope of the invention.

The embodiments of the invention in which an exclusive property or privilege is claimed are defined as follows:

1. A binding for a snowboard or a ski having a strap assembly comprising:

(a) a mounting strap:

(b) a stiffening panel with a longitudinal slot defining upper and lower rails; and (c) at least one stiffening member that engages the upper and lower rails;

(d) an attachment strap attached to the binding opposite the mounting strap;

wherein the stiffening panel comprises a middle strap portion of the strap assembly and is connected to the binding with the mounting strap and the binding strap.

2. The binding of claim 1, wherein the stiffening member slidably engages the upper and lower rails.

3. The binding of claim 1, wherein the stiffening panel comprises an internal panel disposed within an outer covering.

4. The binding of claim 3, wherein the outer covering further comprises a rear panel defining a longitudinal slot that provides access to the at least one stiffening member.

5. The binding of claim 4, wherein the rear panel comprises a polymeric foam.

6. The binding of claim 5, wherein the polymeric foam rear panel comprises a co-molded panel formed from at least two polymeric foams.

7. The binding of claim 1, wherein the at least one stiffening member comprises a center body portion, and oppositely disposed end portions, wherein the end portions comprise a relatively rigid plastic defining a channel and wherein during use each end portion slidably engages one of the upper and lower rails.

8. The binding of claim 7, wherein the body portion of the stiffening member comprises a plastic different from the rigid plastic comprising the end portions.

9. The binding of claim 7, wherein the body portion of the stiffening member is contoured to define arcuate recesses.

10. The binding of claim 1, wherein the rails further comprise a plurality of locking features, and the at least one stiffening member comprises a complementary locking feature that is sized and positioned to selectively engage one of the plurality of rail locking features, such that the stiffening member tends to be retained at a selected position.

11. The binding of claim 1, wherein the strap assembly is an ankle strap for a snowboard binding.

12. The binding of claim 11, wherein the mounting strap is a slotted-ladder type strap.

13. The binding of claim 1, wherein the mounting strap is adjustably attachable on one side of the middle strap portion, and further comprising a buckle fixed to an opposite side of the middle strap portion, wherein the buckle is adapted to engage an attachment strap.

14. The binding of claim 1, wherein the at least one stiffening member comprises a first set of stiffening members, and further comprising a second set of stiffening members that are relatively more stiff than the first set of stiffening members.

15. A binding for a snowboard or a ski having a strap member comprising a mounting strap attached on one side of the binding, an attachment strap attached on an opposite side of the binding, and a middle strap portion that attaches to the binding with the mounting strap and the attachment strap, the middle strap portion comprising an external cover, a stiffening panel having a longitudinal slot, the stiffening panel disposed within the cover, and an adjustable means engaging the longitudinal slot, wherein the adjustable means is operable to selectively change the stiffness of the stiffening panel.

16. The binding of claim 15, wherein the longitudinal slot defines upper and lower rails, and the adjustable means is a stiffening member that slidably engages the upper and lower rails.

17. The binding of claim 15, wherein the cover further comprises an elongate aperture positioned to provide access to the adjustable means.

18. The binding of claim 15, wherein the adjustable means comprises a member that extends across the longitudinal slot, wherein the member is movable between a first position wherein the stiffening panel is more flexible about a transverse axis and a second position wherein the stiffening panel is relatively less flexible about the transverse axis.

* * * * *